US005112417A

United States Patent [19]

Sayles

[11] Patent Number: 5,112,417

[45] Date of Patent: May 12, 1992

[54] METHOD OF CONTROLLING THE INCREASE IN POTLIFE OF PROPELLANTS DURING PROCESSING

[75] Inventor: David C. Sayles, Huntsville, Ala.

[73] Assignee: United States of America, Washington, D.C.

[21] Appl. No.: 703,304

[22] Filed: May 20, 1991

[51] Int. Cl.[5] ..... D03D 23/00

[52] U.S. Cl. ..... 149/109.6; 149/42; 149/76; 149/19.4; 149/19.9; 149/108.8; 149/113; 149/21

[58] Field of Search ..... 149/76, 113, 42, 19.4, 149/19.9, 108.8, 109.6, 21

[56] References Cited

U.S. PATENT DOCUMENTS

| | | | |
|---|---|---|---|
| H717 | 12/1989 | Stephen et al. | 149/19.9 |
| 3,919,011 | 11/1975 | Oberth et al. | 149/19.9 |
| 3,953,260 | 4/1976 | Braun et al. | 149/19.9 |
| 4,019,933 | 4/1977 | Cuksee et al. | 149/19.4 |
| 4,181,545 | 1/1980 | Anderson | 149/19.9 |
| 4,925,504 | 5/1990 | Sayles | 149/19.9 |
| 5,002,797 | 3/1991 | Sayles | 199/5 |

*Primary Examiner*—Stephen J. Lechert, Jr.

[57] ABSTRACT

Tris(N-nitrosophenylhydroxylaminium)aluminum is employed in amounts from about 0.1% by weight to about 0.2% by weight to inhibit the polymerization reaction during propellant mixing. With a weight percent of 0.2 percent, the inhibitor inhibited polymerizaiton to control end-of-mix viscosities to 12 Kp and 13 Kp compared to control propellant viscosities of 26 Kp and 39 Kp after 8 hours and 10 hours respectively. The test propellant and control propellant contained the name ingredients with the exception of the 0.2% additive of the inhibitor in the test propellant. The propellant composition for control and test comprised ammonium perchlorate of 400 micrometer, 200 micrometers, and 20 micrometers in weight percent amounts of 29.5,30.0, and 5.0 respectively, aluminum powder 14.0 weight percent, cyclotetramethylenetetranitramine oxidizer of 4 micrometers particle size in amount of 10.0 weight percent, and hydroxyl-terminated polybutadiene prepolymer binder in a weight percent amount of 11.4 with an isophorone diisocyanate curative and crosslinking agent with an isocyanate to hydroxyl ratio of 0.89 weight percent.

3 Claims, 1 Drawing Sheet

METHOD OF CONTROLLING THE INCREASE IN POTLIFE OF PROPELLANTS DURING PROCESSING

DEDICATORY CLAUSE

The invention described herein may be manufactured, used, and licensed by or for the Government for governmental purposes without the payment to me of any royalties thereon.

BACKGROUND OF THE INVENTION

High burning rate propellants are generally formulated with very fine oxidizer particle sizes; however, the very fine particle sizes (20 micrometers) results in decreased usable potlife. Potlife refers to the time that the propellant can be stored before its viscosity becomes too high for it to be readily cast into a rocket motor. An alternate definition for a usable potlife is the time available for accomplishing the processing steps of mixing and casting a propellant composition before the propellant composition loses its fluid nature.

Aziridine compounds and adducts thereof have been effective in extending potlife. For example, U.S. Pat. No. 4,019,933, issued on Apr. 26, 1977 to Marjorie T. Cucksee et al. and assigned to the United States of America as represented by the Secretary of the Army, Washington, D.C., discloses trisaziridinylphosphine oxides adducts formed by reacting these oxides or their derivatives with monofunctional carboxylic acids.

To provide a better understanding of a number of compounds disclosed by U.S. Pat. No. 4,019,933, applicant presents structure VI, VII, and VIII from Column 3 and 4 of the above patent and which are referred to as HX874,HX868, and PEA respectively, as follows:

The compounds which are trisazirdinyl derivatives of triazine (represented by structure VI), the trisaziridinyl derivatives of benzenetriacyl (represented by structure VII), or N-phenethylaziridine (represented by structure VIII) are equally effective in extending the useful pot life of propellant mix.

STRUCTURE VI

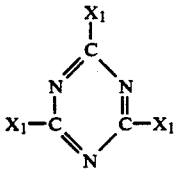

Wherein $X_1$, is an aziridine group:

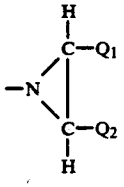

and $Q_1$, and $Q_2$ are either hydrogen or alkyl groups of one to four carbon atoms.

STRUCTURE VII

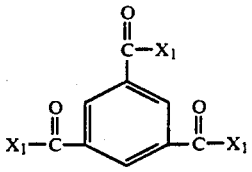

wherein $X_1$ is as described for structure VI.

STRUCTURE VIII

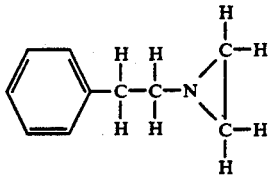

The cure catalysis function of ammonium perchlorate in propellants is believed to be related to the effective surface area of the ammonium perchlorate; the greater the surface area, the faster the curing rate with a corresponding increase in viscosity in a shorter time period of mixing. Thus, the coating of the fine ammonium perchlorate with the adducts formed from reacting aziridinylphosphine oxide with the monofunctional carboxylic acids inhibits or prevents the catalysis of the urethane type reaction (isocyanate-hydroxyl reaction) thus greatly extending the potlife, the time available for processing and casting propellant. The measurement of potlife can be related to vicosity measurements. The viscosity measurement on a Brookfield viscosimeter is arbitrarily set at the time it takes for the viscosity to reach 40 kilopoises.

The desire to control potlife during propellant processing is a motivative stimulus to the artisan. Not only is a propellant composition's useful life important in processing and casting to save mixing time and energy, but the useful life as determined by potlife can have major effects on the properties of the cured propellant, particularly, in the control of voids and maintaining homogeneity of the propellant ingredients in the cured propellant grain.

A compound which can control potlife and which contains a fuel contributing ingredient is recognized for its multifunctional properties and benefits.

Therefore, an object of the invention is to provide a method of controlling the increase in potlife of propellants during processing.

Another object of this invention provide a compound which after being incorporated into a propellant composition, the rate of viscosity increase is slowed by inhibiting the polymerization reaction in the propellant mix.

SUMMARY OF THE INVENTION

Controlling the increase in viscosity (potlife) of solid propellants during processing is achieved by incorporating into the propellant composition mix the organoaluminum compound, tris(N-nitrosophenylhydroxylaminium)aluminum, whose structural formula is depicted as follows:

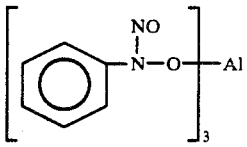

An effective amount of the compound ranges in weight percentages from about 0.1% to about 0.2%. The useful potlife is the time that a propellant composition can be stored before its viscosity becomes too high for it to be readily cast into a rocket motor.

The effectiveness of the above organoaluminum compound improves with increasing amounts to an optimum level in the propellant composition. The compound was evaluated in a propellant composition containing a multi-modal blend of ammonium perchlorate of 400-micrometers, 200-micrometers, and 20-micrometers particle sizes in total weight percent of 29.5%, 30.0%, and 5.0% respectively, aluminum powder 14.0 weight percent, cyclotetramethylenetetranitramine (HMX) of 4-micrometers particle size 10.0 weight percent, hydroxyl-terminated polybutadiene prepolymer 11.4 weight percent, and isophorone diisocyanate (isocyanate/hydroxyl ratio) of 0.89. End-of-mix viscosities in kilopoises (Kp) for a control propellant with 0.2% organoaluminum compound varied from 9 Kp after 4 hours to 39 Kp after 10 hours while the test propellant with 0.2% organoaluminium compound varied from 9 Kp after 4 hours to 13 Kp after 10 hours.

DESCRIPTION OF THE PREFERRED EMBODIMENT(S)

The organoaluminum compound, tris(N-nitrosophenylhydroxylaminium)aluminum, functions as polymerization inhibitor in the mixing of solid propellant ingredients. Inhibiting the polymerization reaction controls the increase in the viscosity and thereby increases potlife. Potlife refers to the time that the propellant can be stored before its viscosity becomes too high for it to be readily cast into the rocket motor.

Figure 1:
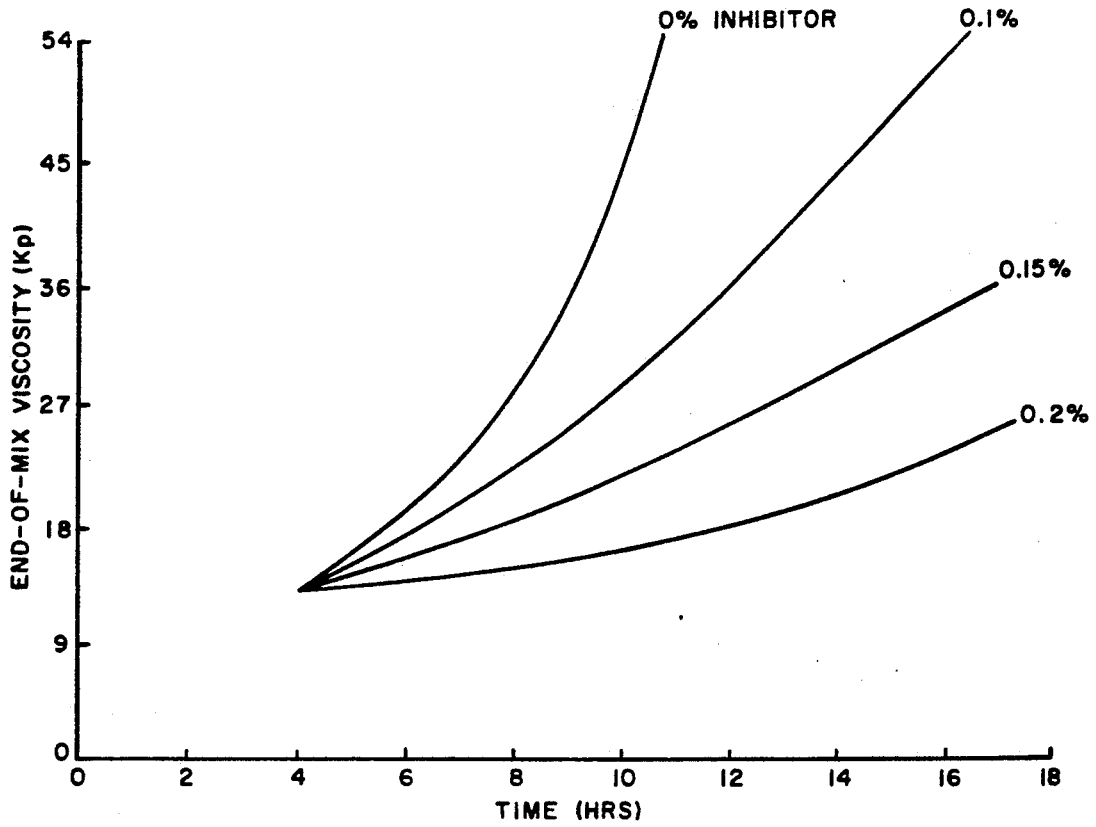
FIG. 1 of the Drawing depicts end-of-mix viscosities (Kp) after various time intervals for various percentages of polymerization inhibitor tris-(N-nitrosophenylhydroxylaminium)aluminum employed in test propellant compositions compared with control propellant composition with zero percent polymerization inhibitor.
Figure 2:
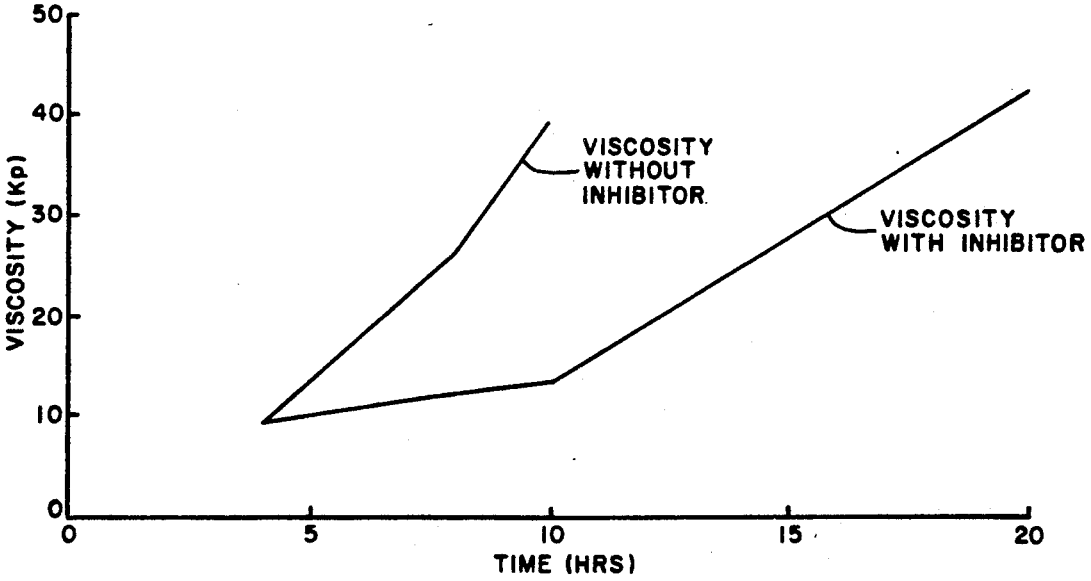
FIG. 2 depicts time to reach viscosity of 40 kilopoises, i.e., terminal viscosity or usable potlife in propellant without polymerization inhibitor and with polymerization inhibitor.

In further reference to FIGS. 1 and 2 of the Drawing, and the data set forth in Table I hereinbelow, the end-of-mix viscosity values vary in proportion to the concentration of the inhibitor with a slower rate of increase in viscosities with time in hours from beginning of mix. For example, end of mix viscosities for control and test propellants are essentially the same after 4 hours whereas after 8 and 10 hours the viscosities are 26 Kp and 39 Kp for control and 12 Kp and 13 Kp for test propellant respectively. FIG. 2 further illustrates potlife for control propellant (without inhibitor) and test propellant (with inhibitor).

TABLE I

Effectiveness of Tris(N-Nitrosphenylhydroxylaminium)-aluminum in Controlling Increase in Viscosity

| Composition/ Characteristics | Propellant A (Wt %) | Propellant B (Wt %) |
|---|---|---|
| Composition | | |
| Ammonium Perchlorate (400-micrometers) | 29.5 | 29.5 |
| Ammonium Perchlorate (200-micrometers) | 30.0 | 30.0 |
| Ammonium Perchlorate (20-micrometers) | 5.0 | 5.0 |
| Aluminum Powder | 14.0 | 14.0 |
| HMX* (4-micrometers) | 10.0 | 10.0 |
| Hydroxyl-terminated Polybutadiene Prepolymer | 11.4 | 11.4 |
| Isophorone Diisocyanate (Isocyanate/ Hydroxyl ratio) | 0.89 | 0.89 |
| Tris(N-Nitrosophenylhydroxylaminium) aluminum** | 0. | 0.2 |
| Characteristics | | |
| End-Of-mix Viscosity | | |
| 4 hrs (Kp) | 9 | 9 |
| 8 hrs (Kp) | 26 | 12 |
| 10 hrs (Kp) | 39 | 13 |
| Shore Hardness | 40 | 42 |

*Cyclotetramethylenetetranitramine
**Manufactured by WAKO Pure Chemical Industries Ltd 10 Doshomachi 3-Clome Higashi-KU Osaha 541, Japan Typically, the propellant composition, such as, the above composition A, which has a tendency to reach a viscosity of 40 kilopoises or a terminal vicosity, or near end of potlife after about 10 hours, but with a polymerization inhibitor the viscosity is only about 13 kilopoises for propellant composition B thereby providing additional time for storing or casting propellant.

The inhibitor is useful for controlling viscosity in propellants employing fine inorganic oxidizer (AP) and additionally containing a very fine organic oxidizer such as HMX or RDX (cyclotrimethylenetrinitramine).

I claim:

1. A method of controlling the increase in potlife of a propellant composition during processing said method comprising:

(i) providing a propellant composition having the characteristics of a decreased potlife when processed without a polymerization inhibitor, said propellant composition comprised of an inorganic oxidizer salt of ammonium perchlorate of about 64.5 weight percent consisting of a blend of 400 micrometers particle size, 200 micrometer particle size, and 20 micrometer particle size; aluminum powder of about 14.0 weight percent; an organic oxidizer salt of about 10.0 weight percent; hydroxyl terminated polybutadiene prepolymer of about 11.4 weight percent, and isophorone diisocyanate in an isocyanate to hydroxyl ratio of about 0.89;

(ii) incorporating into said propellant composition an additive from about 0.1 weight percent to about 0.2 weight percent of the polymerization inhibitor tris(N-nitrosophenylhydroxylaminium)aluminum to control the increase in the viscosity during processing; and, (iii) blending said propellant composition containing said additive to achieve an end-of-mix viscosity and extended potlife to enable said propellant composition to be stored for an extended time period before its viscosity becomes too high for the propellant composition to be readily cast into a rocket motor.

2. The method of controlling the increase in potlife of a propellant composition during processing, as defined in claim 1, wherein said inorganic salt, ammonium perchlorate, of particle sizes 400-micrometers, 200-micrometers, and 20 micrometers are present in weight percent amounts of about 29.5, 30.0, and 5.0 respectively; and wherein said organic oxidizer salt is cyclotetramethylenetetranitramine of about 4 micrometers particle size.

3. The method of controlling the increase in potlife of a propellant composition as defined in claim 2 wherein said tris(N-nitrosophenylhydroxylaminum)aluminum is employed in an amount about 0.2 weight percent and wherein said end-of-mix viscosity after 10 hours is about 13 kilopoises compared with an end-of-mix viscosity after 10 hours of about 39 kilopoises for a like propellant composition which does not contain said polymerization inhibitor, tris(N-nitrosophenylhydroxylaminium)-aluminum.

* * * * *